US008327502B2

(12) United States Patent
Tsai

(10) Patent No.: US 8,327,502 B2
(45) Date of Patent: Dec. 11, 2012

(54) CENTRIFUGAL DEHYDRATING DEVICE FOR MOP

(76) Inventor: Yao-Feng Tsai, Xinhua Township, Tainan County (TW)

( * ) Notice: Subject to any disclaimer, the term of this patent is extended or adjusted under 35 U.S.C. 154(b) by 366 days.

(21) Appl. No.: 12/728,162

(22) Filed: Mar. 19, 2010

(65) Prior Publication Data

US 2011/0225762 A1 Sep. 22, 2011

(51) Int. Cl.

| | |
|---|---|
| ***A47L 13/14*** | (2006.01) |
| ***A47L 13/58*** | (2006.01) |
| ***F26B 17/24*** | (2006.01) |
| ***F26B 17/30*** | (2006.01) |
| ***D06F 29/00*** | (2006.01) |
| ***D06F 35/00*** | (2006.01) |
| ***B01D 24/32*** | (2006.01) |
| ***B01D 33/00*** | (2006.01) |
| ***B01D 35/00*** | (2006.01) |
| ***B01D 35/22*** | (2006.01) |
| ***C02F 1/38*** | (2006.01) |

(52) U.S. Cl. ..... 15/260; 15/263; 34/58; 68/23.3; 210/360.1

(58) Field of Classification Search ..... 15/260, 15/263, 264; 34/58, 108; 68/241, 23 R, 68/23.3, 23 A; 210/360.1, 247

See application file for complete search history.

(56) References Cited

U.S. PATENT DOCUMENTS

| | | | | |
|---|---|---|---|---|
| 6,115,877 | A * | 9/2000 | Morad et al. | 15/261 |
| 7,743,528 | B2 * | 6/2010 | Lin | 34/58 |
| 7,828,001 | B2 * | 11/2010 | Lamb | 134/104.2 |
| 7,909,174 | B1 * | 3/2011 | Yu | 210/403 |
| 8,028,369 | B2 * | 10/2011 | Chiang | 15/260 |
| 8,056,179 | B2 * | 11/2011 | Hsu | 15/260 |
| 8,065,777 | B2 * | 11/2011 | Lin | 15/260 |
| 8,156,607 | B2 * | 4/2012 | Chiang | 15/260 |
| 2010/0077561 | A1 * | 4/2010 | Yu | 15/260 |
| 2010/0180460 | A1 * | 7/2010 | Tang | 34/58 |
| 2010/0242205 | A1 * | 9/2010 | Chen | 15/263 |
| 2010/0306952 | A1 * | 12/2010 | Chu | 15/260 |
| 2011/0185532 | A1 * | 8/2011 | Lin | 15/260 |
| 2012/0047675 | A1 * | 3/2012 | Chu | 15/260 |

* cited by examiner

*Primary Examiner* — Vanitha Elgart

(57) ABSTRACT

A centrifugal dehydrating device includes a bucket receiving a cylinder for receiving a mop. A shaft is mounted to a bottom of the cylinder. An annular sleeve is formed on the bottom of the cylinder and engaged with an annular fender on a mounting plate. A water fender includes a skirt having a top portion with an annular groove for receiving a rim of the cylinder. An annular wing extends radially inward from the top portion of the skirt. Water splashing upward from the cylinder during rotation of the cylinder is stopped by the annular wing. A top seat is fixed to a bottom side of the mounting plate and receives a gear train. The gear train meshes with and is driven by a rack on a pedal such that stepping of the pedal causes rotation of the gear train, the shaft, and the cylinder.

6 Claims, 5 Drawing Sheets

CENTRIFUGAL DEHYDRATING DEVICE FOR MOP

BACKGROUND OF THE INVENTION

1. Field of the Invention

The present invention relates to a dehydrating device for a mop and, more particularly, to a waterproof centrifugal dehydrating device for a mop with enhanced dehydrating efficiency and a longer service life.

2. Description of the Related Art

Conventionally, mops are manually wrung dry. To avoid time-consuming and laborsome wringing, centrifugal dehydrating devices have been proposed and generally include a bucket, a rotary container, and a transmission mechanism. The rotary container is mounted in the bucket and includes a one-way bearing. The transmission mechanism includes a pedal that can be stepped to move the rotary container in a single direction for dehydrating water contained in a mop placed in the rotary container. The water flying away from the mop under the action of the centrifugal force flows into the bucket. However, the transmission mechanism is liable to be splashed by the water flying away from the mop, leading to malfunction of the one-way bearing. Furthermore, stepping the pedal is laborsome, and the rotating speed of the rotary container is too low to provide satisfactory dehydrating effect.

Thus, a need exists for a waterproof centrifugal dehydrating device for a mop with enhanced dehydrating efficiency and a longer service life.

BRIEF SUMMARY OF THE INVENTION

The present invention solves this need and other problems in the field of waterproof, efficient dehydrating device for mops by providing, in a preferred form, a dehydrating device including a bucket having a compartment. The compartment has a receiving space in a side thereof. A mounting plate is provided below the receiving space and includes an axial hole surrounded by an annular fender. The bucket further includes a recessed portion below the mounting plate and aligned with the receiving space. A rotary container is rotatably mounted in the receiving space. The rotary container includes a hollow cylinder adapted to receive a bottom portion of a mop. The cylinder includes a plurality of slits through which water is passable. A shaft is mounted to a bottom of the cylinder. An annular sleeve is formed on the bottom of the cylinder and engaged with the annular fender. A water fender is received in an upper portion of the receiving space. The water fender includes a skirt having a top portion with an annular groove. The annular groove receives a rim of the cylinder. An annular wing extends radially inward from the top portion of the skirt of the water fender. The annular wing has an inner face at an angle smaller than 90° in the most preferred form to the skirt of the water fender. The water splashing upward from the rotary container during rotation of the rotary container is stopped by the annular wing. A transmission mechanism includes a base, a pedal, an elastic element, a top seat, and a gear train. The pedal includes a lower end pivotably coupled to the base. The pedal further includes a rack board having a rack. A stepping portion is fixed to the rack board to move therewith. The top seat is mounted in an upper section of the recessed portion and fixed to a bottom side of the mounting plate of the bucket. The top seat includes a first gear compartment. The gear train includes a first gear mounted in the first gear compartment and aligned with the axial hole of the bucket. A one-way bearing is coaxially mounted to the first gear. The shaft is extended through the axial hole of the bucket and coupled with the one-way bearing. The gear train meshes with and is driven by the rack of the pedal such that stepping of the pedal portion causes rotation of the gear train, the shaft, and the rotary container.

In the most preferred form, an upper shaft sleeve is received in the axial hole of the bucket. The upper shaft sleeve is made of abrasion-resistant material and extended through by the shaft. The base further includes a vertical board extending upright from a side thereof. A peg is formed on the vertical board. The rack board further includes an arcuate slot having a length corresponding to a travel of the rack. The arcuate slot slideably receives the peg. The elastic element is a torsion spring having two tangs abutting against the base and the pedal for returning the pedal. The top seat further includes a second gear compartment and a third gear compartment. The third gear compartment receives an axle. The top seat further includes a hollow post through which the shaft extends. The gear train further includes second, third, fourth, and fifth gears. The second and third gears are coaxially fixed together and received in the second and third gear compartments. The second gear has a diameter larger than the third gear and meshed with the first gear. The first gear has a diameter smaller than the second gear. The fourth and fifth gears are coaxially fixed together and extended through by the hollow post. A shaft sleeve is mounted below the hollow post to position the fourth and fifth gears. The fourth gear meshes with and having a diameter larger than the third gear. The fifth gear has a diameter smaller than the fourth gear and meshes with the rack of the pedal.

By such an arrangement, water is prevented from entering the one-way bearing, providing a longer service life. Furthermore, operation of the dehydrating device is stable and labor-saving. Further, the rotary container can rotate at a high speed while providing operating convenience and enhanced efficiency.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
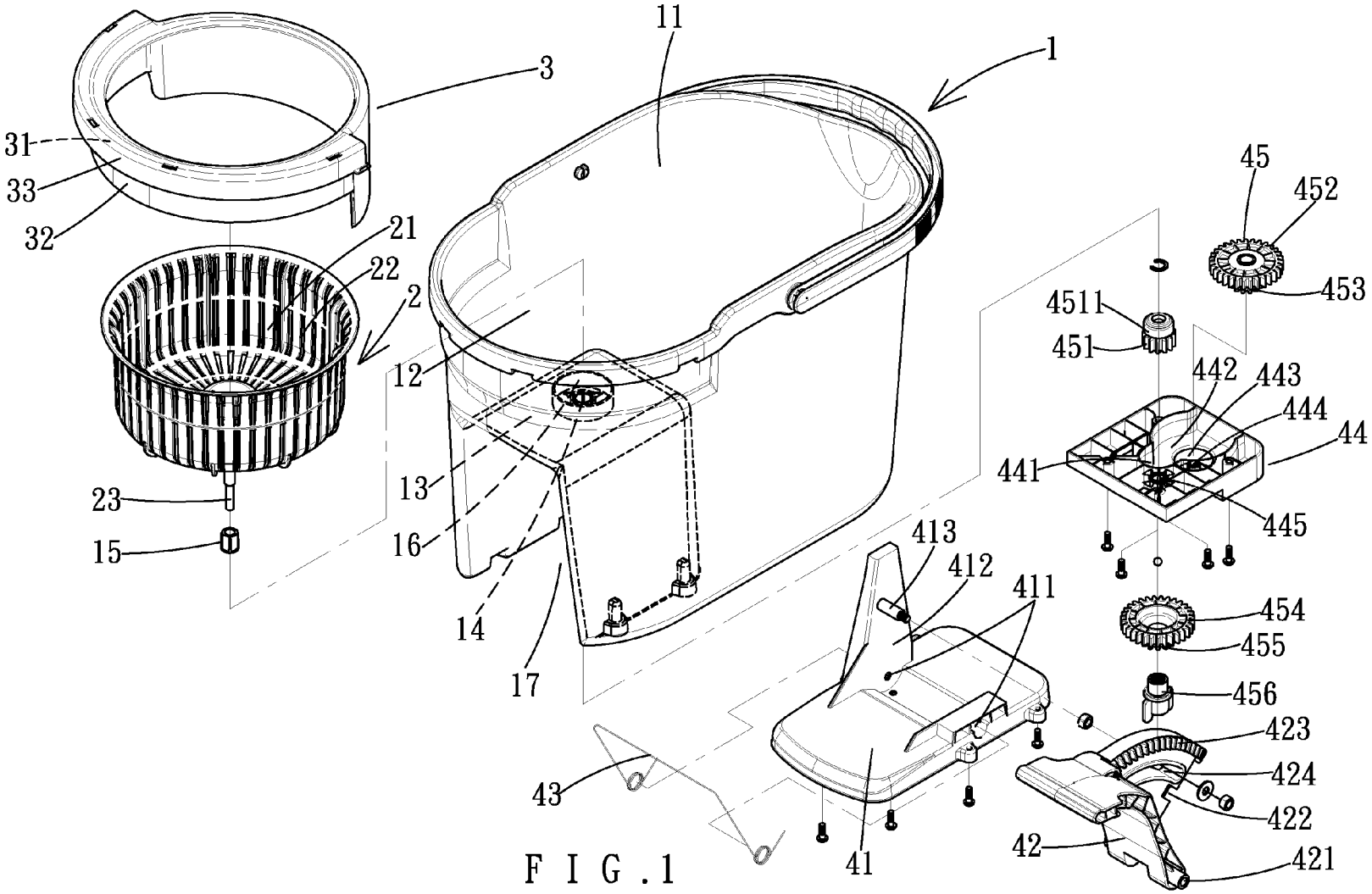
FIG. 1 shows an exploded, perspective view of a centrifugal dehydrating device for a mop according to the preferred teachings of the present invention.
Figure 2:
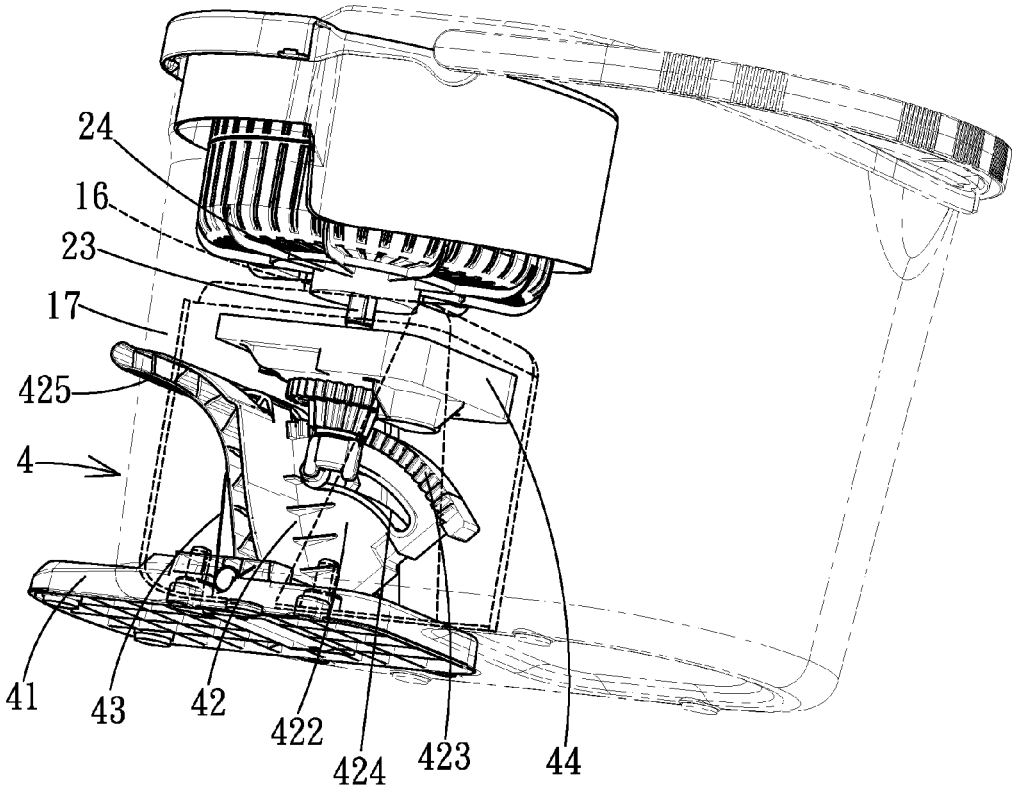
FIG. 2 shows a perspective view of the centrifugal dehydrating device of FIG. 1 with a bucket of the dehydrating device shown in phantom lines.
Figures 3, 3A:
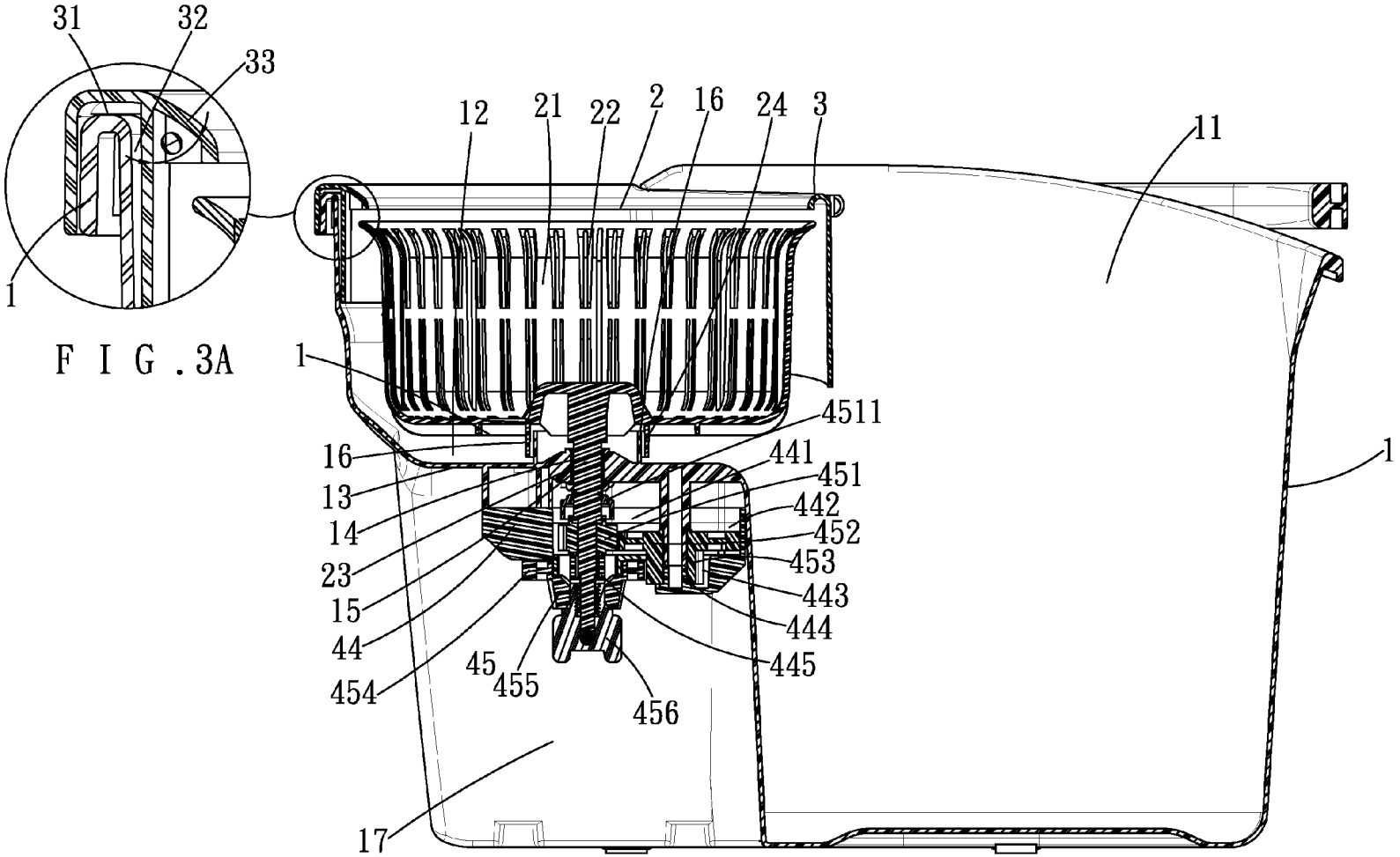
FIG. 3 shows a cross sectional view of the centrifugal dehydrating device of FIG. 1.
FIG. 3A shows an enlarged view of a circled portion of FIG. 3.

With reference to FIGS. 1-3, a centrifugal dehydrating device for a mop according to the preferred teachings of the present invention generally includes a bucket 1, a rotary container 2, a water fender 3, and a transmission mechanism 4. The bucket 1 includes a compartment 11 having a receiving space 12 in a side thereof. A mounting plate 13 is provided below the receiving space 12 and includes an axial hole 14 receiving an upper shaft sleeve 15 made of abrasion-resistant material. An annular fender 16 surrounds the axial hole 14. The bucket 1 further includes a recessed portion 17 below the mounting plate 13 and aligned with the receiving space 12.

Figures 4, 4A:
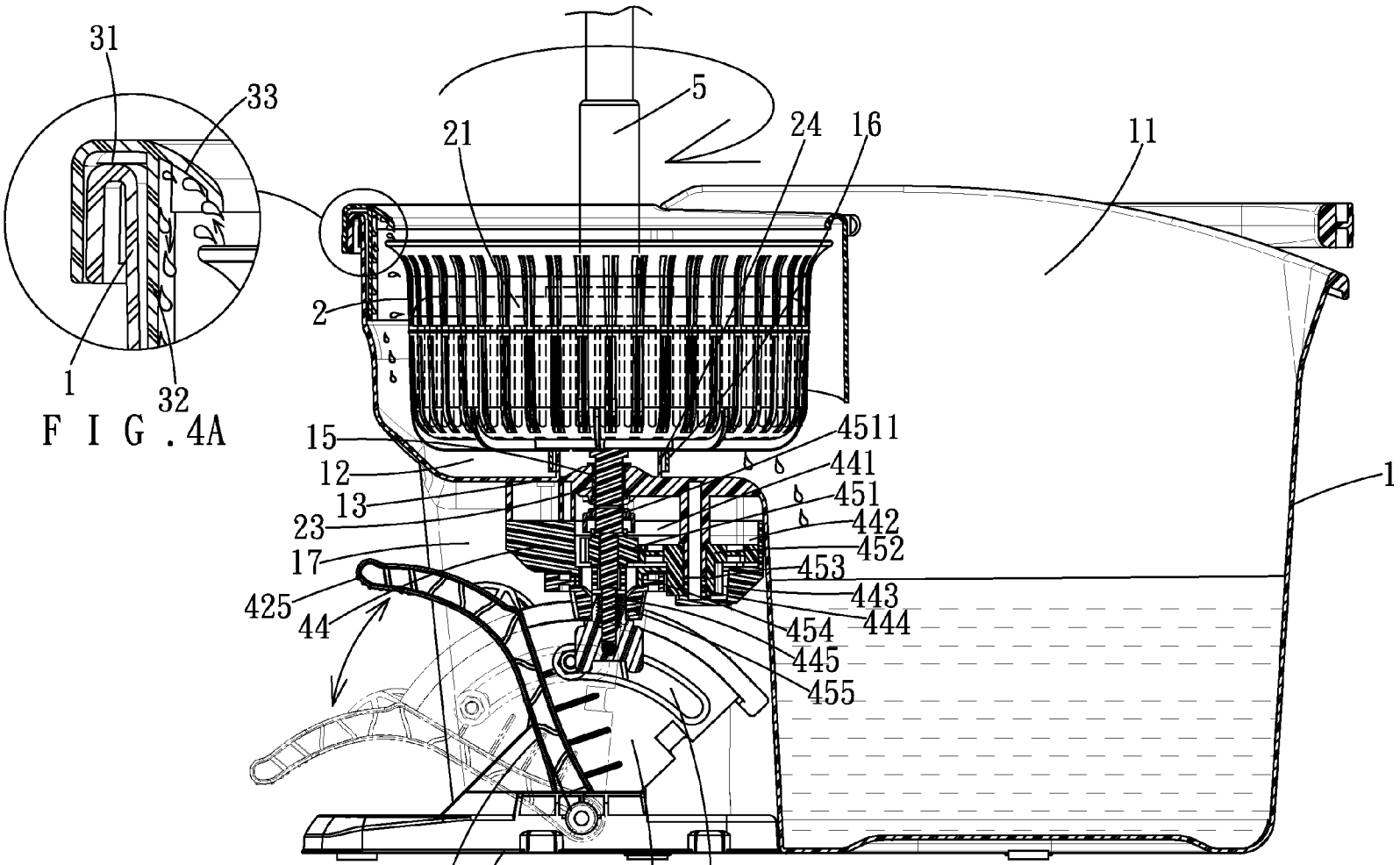
FIG. 4 shows a cross sectional view of the centrifugal dehydrating device of FIG. 1, illustrating operation of the dehydrating device.
FIG. 4A shows an enlarged view of a circled portion of FIG. 4.

The rotary container 2 is rotatably mounted in the receiving space 12 and includes a hollow cylinder 21 for receiving a bottom portion of a mop 5 (FIG. 4). The cylinder 21 includes a plurality of slits 22 through which water is passable. A shaft 23 is mounted to a bottom of the cylinder 21. An annular sleeve 24 is formed on the bottom of the cylinder 21 and engaged with the annular fender 16.

The water fender 3 is mounted in a top portion of the bucket 11. Specifically, the water fender 3 is received in an upper portion of the receiving space 12. The water fender 3 is substantially ring-shaped and includes a skirt 32 having a top portion with an annular groove 31 for receiving a rim of the cylinder 21. An annular wing 33 extends radially inward from the top portion of the skirt 32 of the water fender 3. In the most preferred form shown, the annular wing 33 has an inner face at an angle θ smaller than 90° to the skirt 32 of the water fender 3.

The transmission mechanism 4 includes a base 41, a pedal 42, an elastic element 43, a top seat 44, and a gear train 45. The base 41 is fixed by fasteners in a lower section of the recessed portion 17. The base 41 includes a pivotal portion 411 at an upper side thereof. A vertical board 412 extends upright from a side of the base 41 and includes a peg 413 extending perpendicularly from the vertical board 412. The pedal 42 includes a pivotal portion 421 at a lower end thereof. The pivotal portion 421 includes an axle pivotably coupled to the pivotal portion 411 of the base 41. The pedal 42 further includes a rack board 422 formed on a side thereof. The rack board 422 is sector-shaped in the preferred form shown and includes an arcuate rack 423 on an upper portion thereof. The rack board 422 further includes an arcuate slot 424 having a length corresponding to the travel of the rack 423 and slideably receiving the peg 413 for providing stable movement of the rack board 422. A stepping portion 425 is fixed to the rack board 422 to move therewith. The stepping portion 425 extends beyond the recessed portion 17 and can be stepped by a user. The elastic element 43 is in the form of a torsion spring in the preferred form shown and includes two tangs respectively abutting against the base 41 and the pedal 42 for returning the pedal 42. The top seat 44 is mounted in an upper section of the recessed portion 17 and fixed by fasteners to a bottom side of the mounting plate 13 of the bucket 1. The top seat 44 includes first, second, and third gear compartments 441, 442, and 443. The third gear compartment 443 receives an axle 444. The top seat 44 further includes a hollow post 445 with inner threading.

The gear train 45 includes first, second, third, fourth, and fifth gears 451, 452, 453, 454, and 455. The first gear 451 is mounted in the first gear compartment 441 of the top seat 44 and aligned with the axial hole 14 of the bucket 1. Furthermore, a one-way bearing 4511 is coaxially mounted on top of the first gear 451. The second and third gears 452 and 453 are coaxially fixed together and received in the second and third gear compartments 442 and 443 of the top seat 44. The second gear 452 has a diameter larger than the third gear 453. Further, the second gear 452 meshes with the first gear 451 having a diameter smaller than the second gear 452. The fourth and fifth gears 454 and 455 are coaxially fixed together and extended through by the hollow post 445 of the top seat 44. A shaft sleeve 456 is mounted below the hollow post 445 to position the fourth and the fifth gears 454 and 455. The fourth gear 454 has a diameter larger than the third gear 453 and meshes with the third gear 453. The fifth gear 455 has a diameter smaller than the fourth gear 454 and is in the form of a bevel gear meshed with the rack 423 of the pedal 42. The shaft 23 of the rotary container 2 is extended through the upper shaft sleeve 15 in the axial hole 14 of the bucket 1 and the hollow post 445 such that the shaft 23 rotates jointly with the one-way bearing 4511. The upper shaft sleeve 15 prevents wear of the inner periphery of the axial hole 14 during rotation of the shaft 23.

Figure 5:
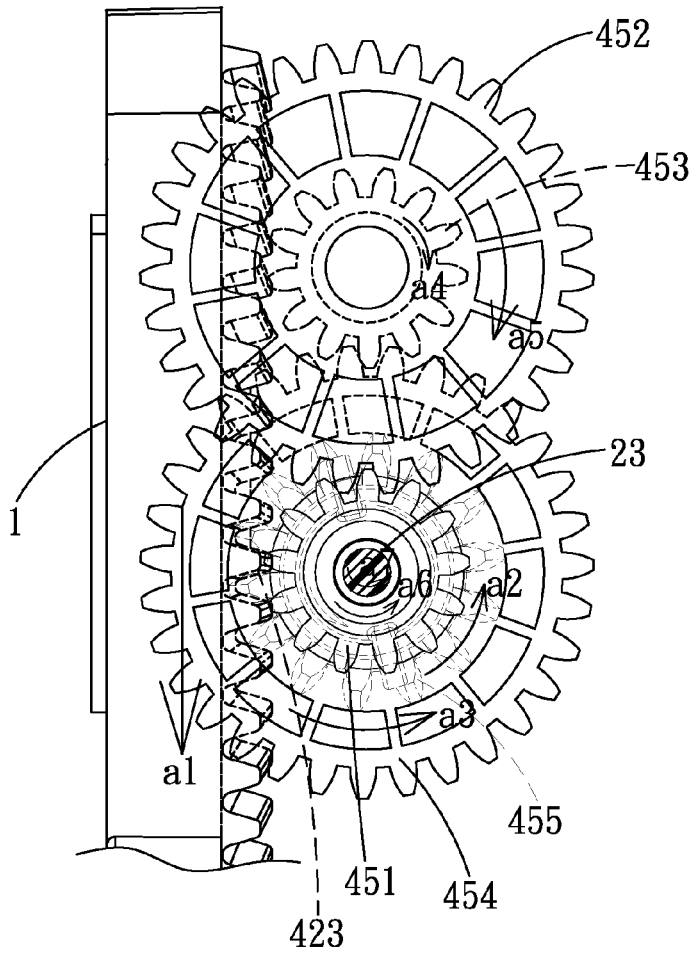
FIG. 5 shows a partial, top view of a portion of the centrifugal dehydrating device of FIG. 1, illustrating rotation of a transmission mechanism driven by a rotary container.

With reference to FIGS. 4 and 5, the bottom portion of the mop 5 that has absorbed water is placed in the cylinder 21 of the rotary container 2, and the user steps on the stepping portion 425 of the pedal 42, causing the pedal 42 to pivot relative to the base 41, which, in turn, drives the first, second, third, fourth, and fifth gears 451-455, the shaft 23, and the rotary container 2 to rotate. When the pedal 42 is released, the resiliency of the elastic element 43 returns the stepping portion 425 of the pedal 42 to its original position. Due to coupling between the one-way bearing 4511 on the first gear 451 and the shaft 23 of the rotary container 2, the shaft 23 does not rotate when the stepping portion 425 returns to its original position. Repeated stepping of the pedal 42 causes rotation of the rotary container 2 in a single direction to remove the water contained in the mop 5. During dehydration of the mop 5, the water splashing upward from the rotary container 2 is stopped by the annular wing 33 of the water fender 3. Furthermore, since the annular sleeve 24 of the rotary container 2 is engaged with the annular fender 16 of the bucket 1 and since the first gear 451 is received in the first gear compartment 441 of the top seat 44 that provides a sealing effect, leakage of water into the one-way bearing 4511 is prevented, providing stable operation and a longer service life.

With reference to FIG. 5, when the pedal 42 is stepped in a direction shown by arrow a1, the rack 423 drives the fifth gear 455 of a smaller diameter to rotate in a direction shown by arrow a2 and increases the rotating speed. The fourth gear 454 having a larger diameter is driven to rotate in a direction shown by arrow a3 and drives the third and second gears 453 and 452 to rotate in a direction shown by arrows a4 and a5. After buffering by the third and second gears 453 and 452, the first gear 451 is driven by the second gear 452 to rotate in a direction shown by arrow a6, which, in turn, drives the shaft 23 to rotate in a direction shown by arrow a7. Thus, the second and third gears 452 and 453 provide buffering effect to prevent the fourth and fifth gears 454 and 455 from directly driving the first gear 451 and the shaft 23. Force-saving effect is, thus, provided. Furthermore, the driven gear is smaller than the driving gear to increase the rotating speed. Specifically, the fifth, third, and first gears 455, 453, and 451 are smaller in diameter and respectively driven by the rack 423, the second gear 452, and the fourth gear 454. Thus, the first gear 451 and the rotary container 2 can rotate at a high speed while allowing labor-saving operation. The operational convenience and efficiency are, thus, enhanced while providing a waterproof design.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A centrifugal dehydrating device for a mop comprising: a bucket including a compartment having a receiving space in a side thereof, with a mounting plate provided below the receiving space and including an axial hole, with an annular fender surrounding the axial hole, with the bucket further including a recessed portion below the mounting plate and aligned with the receiving space; a rotary container rotatably mounted in the receiving space, with the rotary container including a hollow cylinder adapted to receive a bottom portion of a mop, with the cylinder including a plurality of slits through which water is passable, with a shaft mounted to a bottom of the cylinder, with an annular sleeve formed on the bottom of the cylinder and engaged with the annular fender; a water fender received in an upper portion of the receiving space, with the water fender including a skirt having a top portion with an annular groove, with the annular groove receiving a rim of the cylinder, with an annular wing extending radially inward from the top portion of the skirt of the water fender, with the annular wing having an inner face at an angle to the skirt of the water fender, with water splashing upward from the rotary container during rotation of the rotary container being stopped by the annular wing; a transmission mechanism including a base, a pedal, an elastic element, a top seat, and a gear train, with the pedal including a lower end pivotably coupled to the base, with the pedal further including a rack board having a rack, with a stepping portion fixed to the rack board to move therewith, with the top seat mounted in an upper section of the recessed portion and fixed to a bottom side of the mounting plate of the bucket, with the top seat including a first gear compartment, with the gear train including a first gear mounted in the first gear compartment and aligned with the axial hole of the bucket, with a one-way bearing coaxially mounted to the first gear, with the shaft extending through the axial hole of the bucket and coupled with the one-way bearing, with the gear train meshed with and driven by the rack of the pedal such that stepping of the pedal portion causes rotation of the gear train, the shaft, and the rotary container.

2. The centrifugal dehydrating device as claimed in claim 1, further comprising: an upper shaft sleeve received in the axial hole of the bucket, with the upper shaft sleeve made of abrasion-resistant material and extended through by the shaft.

3. The centrifugal dehydrating device as claimed in claim 1, with the angle between the inner face of the annular wing and the skirt of the water fender being smaller than 90 degrees.

4. The centrifugal dehydrating device as claimed in claim 1, with the base further including a vertical board extending upright from a side thereof, with a peg formed on the vertical board, with the rack board further including an arcuate slot having a length corresponding to a travel of the rack, with the arcuate slot slideably receiving the peg.

5. The centrifugal dehydrating device as claimed in claim 1, with the elastic element being a torsion spring having two tangs abutting against the base and the pedal for returning the pedal.

6. The centrifugal dehydrating device as claimed in claim 1, with the top seat further including a second gear compartment and a third gear compartment, with the third gear compartment receiving an axle, with the top seat further including a hollow post through which the shaft extends, with the gear train further including second, third, fourth, and fifth gears, with the second and third gears being coaxially fixed together and received in the second and third gear compartments, with the second gear having a diameter larger than the third gear and meshed with the first gear, with the first gear having a diameter smaller than the second gear, with the fourth and fifth gears being coaxially fixed together and extended through by the hollow post, with a shaft sleeve mounted below the hollow post to position the fourth and fifth gears, with the fourth gear meshed with and having a diameter larger than the third gear, with the fifth gear having a diameter smaller than the fourth gear and meshed with the rack of the pedal.

* * * * *